US012564759B2

(12) United States Patent
Liu

(10) Patent No.: US 12,564,759 B2
(45) Date of Patent: Mar. 3, 2026

(54) STAIR STEPPER

(71) Applicant: OHFG TECHNOLOGIES(SHANGHAI) CO., LTD, Shanghai (CN)

(72) Inventor: Ping Liu, Shanghai (CN)

(73) Assignee: OHFG TECHNOLOGIES(SHANGHAI) CO., LTD., Shanghai (CN)

( * ) Notice: Subject to any disclaimer, the term of this patent is extended or adjusted under 35 U.S.C. 154(b) by 247 days.

(21) Appl. No.: 18/603,659

(22) Filed: Mar. 13, 2024

(65) Prior Publication Data

US 2025/0276211 A1 Sep. 4, 2025

(30) Foreign Application Priority Data

Mar. 4, 2024 (CN) ..... 202420413978.X

(51) Int. Cl.
*A63B 22/00* (2006.01)
*A63B 21/00* (2006.01)

(52) U.S. Cl.
CPC ..... *A63B 22/0056* (2013.01); *A63B 21/4034* (2015.10)

(58) Field of Classification Search
CPC ..... A63B 21/4034; A63B 21/4033; A63B 22/0015; A63B 22/0056; A63B 22/04; A63B 22/0048; A63B 22/0058; A63B 22/0061; A63B 22/0064; A63B 22/0066; A63B 22/0069; A63B 2022/0053; A63B 2022/0071; A63B 2022/0074
See application file for complete search history.

(56) References Cited

U.S. PATENT DOCUMENTS

| | | | | |
|---|---|---|---|---|
| 6,709,367 | B1 * | 3/2004 | Liang | A63B 22/0058 482/52 |
| 6,712,739 | B1 * | 3/2004 | Chen | A63B 22/0058 482/53 |
| 7,048,675 | B1 * | 5/2006 | Liang | A63B 22/0064 482/53 |
| 11,318,342 | B2 | 5/2022 | Hsieh | |
| 2008/0026916 | A1 | 1/2008 | Chuang | |
| 2012/0149531 | A1 * | 6/2012 | Chen | A63B 22/0066 482/52 |
| 2018/0236300 | A1 | 8/2018 | Fu | |

* cited by examiner

*Primary Examiner* — Megan Anderson

(57) ABSTRACT

Provided in the invention is a stair stepper. A rotating mechanism includes a first rotating shaft and a second rotating shaft that are fixed in an intersecting manner, and the rotating mechanism is rotatably connected to a base through the first rotating shaft; a pedal mechanism and a linkage member are sequentially connected to the second rotating shaft, a limiting rod is provided on the linkage member, and a transverse rod of the limiting rod is slidably connected to an adapter; a first limiting groove is provided on the pedal mechanism, and a second limiting groove is provided on the base. The limiting rod on the linkage member is located in the first limiting groove or the second limiting groove, so that switching between two motion functions of stepping training and stepping-twisting training is implemented.

10 Claims, 4 Drawing Sheets

A-A

STAIR STEPPER

CROSS REFERENCE TO RELATED APPLICATION

This application claims priority benefit of Chinese Patent Application No. 202420413978X, filed on Mar. 4, 2024, and the entire content of which is incorporated herein by reference.

TECHNICAL FIELD

The present invention relates to the field of fitness equipment, and in particular, to a stair stepper.

BACKGROUND

Daily fitness exercise is especially important for maintaining physical health, especially for people who often sit in the office with limited daily walking and waist activity. Over time, fat accumulation and waist problems may be caused due to lack of exercise. For these office workers, small-sized household stair steppers are preferred for daily exercise. At present, stair steppers in the market are relatively mature and commonly used devices, occupy a small area, are convenient to store, and can be trained at any time. However, the existing stair steppers can achieve a stepping operation of simulating a vertical swing, which belongs to single-function training equipment, cannot synchronize step and twist training, and cannot meet the function switching between the stepping training and the stepping-twisting training.

SUMMARY

An object of the present invention is to provide a stair stepper, which has both a stepping training function and a stepping-twisting training function, and can be rapidly switched between the two functions.

In order to achieve the above object, the present invention provides the following technical solution.

A stair stepper, comprising: a base; a rotating mechanism comprising a first rotating shaft and a second rotating shaft that are fixed in an intersecting manner, the rotating mechanism being rotatably connected to the base through the first rotating shaft; and a pedal mechanism, a first sleeve pipe being provided in the middle of the pedal mechanism, and the pedal mechanism being rotatably sleeved on the second rotating shaft through the first sleeve pipe; the stair stepper further comprises a linkage member, the linkage member comprises a second sleeve pipe, a limiting rod is provided on an outer wall of the second sleeve pipe, a vertical rod of the limiting rod is perpendicular to an axis of the second sleeve pipe and is fixedly connected to the second sleeve pipe, and a transverse rod of the limiting rod is parallel to the axis of the second sleeve pipe; the first sleeve pipe and the second sleeve pipe are sequentially sleeved on the second rotating shaft, and the linkage member is capable of rotating around the second rotating shaft and is capable of sliding on the second rotating shaft; an adapter is rotatably connected to a mounting position, corresponding to the first rotating shaft, on the base, and the transverse rod of the limiting rod is slidably connected to the adapter; a first limiting groove is provided at an edge of a pipe opening at one side, adjacent to the second sleeve pipe, of the first sleeve pipe, and a second limiting groove is provided on the base, so that when the linkage member slides towards the side of the first sleeve pipe, the vertical rod of the limiting rod is capable of entering the first limiting groove, and when the linkage member slides away from the side of the first sleeve pipe, the vertical rod of the limiting rod is capable of entering the second limiting groove.

Further, the linkage member is provided with a U-shaped groove, a sliding block is mounted inside the U-shaped groove, and the transverse rod of the limiting rod is fixedly connected to the sliding block.

Further, the stair stepper further comprises a knob mechanism, wherein an inner wall of the knob mechanism is in threaded connection with the second rotating shaft, and an outer wall of the knob mechanism is connected to one end of the second sleeve pipe through a rotating shaft sleeve, so that the knob mechanism is capable of being axially connected to the second sleeve pipe and is capable of rotating circumferentially relative to the second sleeve pipe.

Further, a through-hole is provided in the base, and the first rotating shaft penetrates through the through-hole and is connected to the base.

Further, a mounting plate is provided at a position, corresponding to the through-hole, on the base, and the adapter is rotatably connected to the mounting plate.

Further, a limiting block is mounted on the mounting plate, and the second limiting groove is provided on one side, corresponding to the through-hole, of the limiting block.

Further, two stopping blocks of a flexible material are further provided on the base; when the pedal mechanism steps downwards, the pedal mechanism is capable of touching the stopping blocks so as to prevent the pedal mechanism from directly colliding with the base.

Further, two stopping blocks of a flexible material are further provided under a pedal of the pedal mechanism; when the pedal mechanism steps downwards, the stopping blocks are capable of touching the base so as to prevent the pedal mechanism from directly colliding with the base.

Further, the base comprises two supporting beams symmetric to left and right, and a crossbeam respectively connected to the two supporting beams in an intersecting manner; the first rotating shaft is mounted on the crossbeam; and included angles between inner sides of the two supporting beams and the crossbeam are acute angles, so that one side between the two supporting beams presents a small opening, and the other side between the two supporting beams presents a large opening. While the stability and safety of the structure during use are ensured, the structure is more compact and the occupation area is smaller.

Further, the adapter and the second limiting groove are provided on the side having the small opening between the two supporting beams.

It can be seen through analysis that a stair stepper disclosed in the present invention has two motion functions of stepping training and stepping-twisting training, and can be rapidly switched between the two functions, thereby providing a user with a plurality of motion functions, being more convenient to use, and having a smoother motion process.

The technical solution of the present invention reduces the operation difficulty, greatly reduces replacement time and working intensity, and reduces costs.

BRIEF DESCRIPTION OF DRAWINGS

The accompanying drawings, which form a part of the present application, are used to provide a further understanding of the present invention. The schematic embodiments of the present invention and the description thereof are used to explain the present invention, and do not form improper limits to the present invention. In the drawings.

Figure 1:
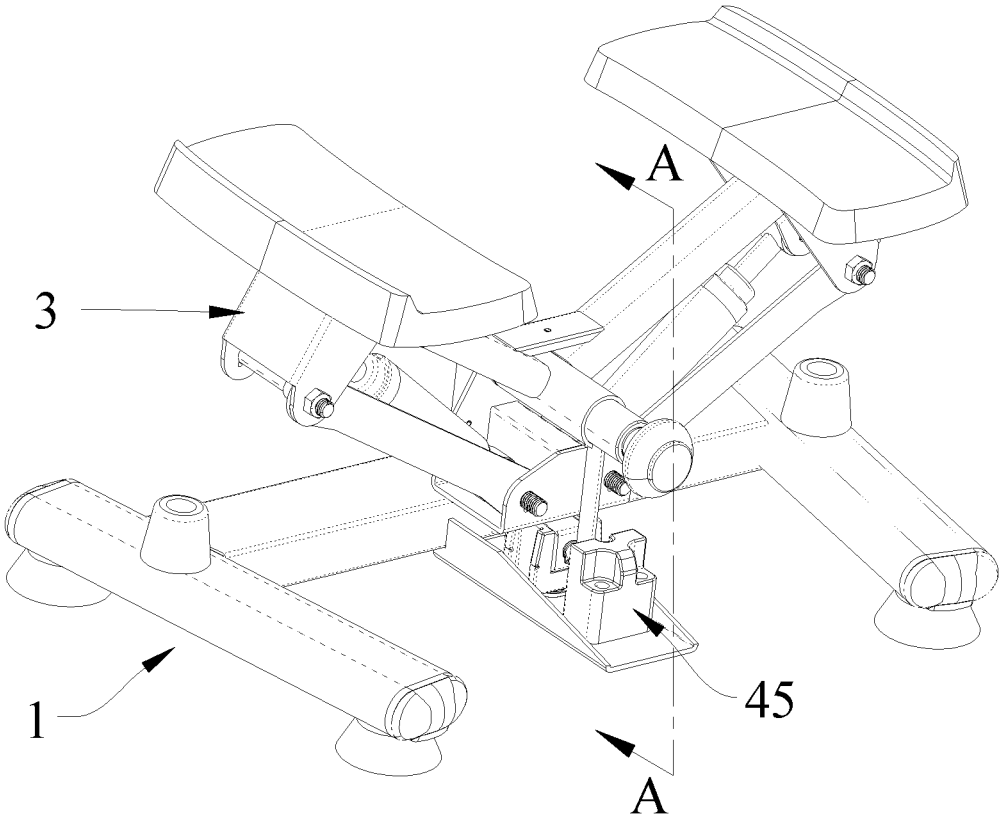
FIG. 1 is a schematic structural diagram of an embodiment of a stair steeper.

Description of reference signs: 1—base; 11—supporting beam; 12—crossbeam; 13—mounting plate; 14—stopping block; 2—rotating mechanism; 21—first rotating shaft; 22—second rotating shaft; 23—connecting plate; 3—pedal mechanism; 31—pedal connecting assembly; 311—first sleeve pipe; 312—first limiting groove; 32—pedal; 33—connecting block; 34—connecting rod; 4—converting mechanism; 41—linkage member; 411—second sleeve pipe; 412—limiting rod; 42—knob mechanism; 43—sliding block; 44—adapter; 45—limiting block; 451—second limiting groove; and 46—rotating shaft sleeve.

DESCRIPTION OF EMBODIMENTS

The present invention will be described below with reference to the drawings and embodiments in detail. The respective examples are provided by way of explanation of the present invention without limiting the present invention. Indeed, it will be apparent to a person skilled in the art that modifications and variations can be made in the present invention without departing from the scope or spirit of the invention. For example, features shown or described as part of one embodiment may be used in another embodiment to produce yet another embodiment. Therefore, it is expected that the present invention includes such modifications and variations within the scope of the accompanying claims and their equivalent.

In the description of the present invention, orientation or position relationships indicated by terms such as "longitudinal", "lateral", "up", "down", "front", "rear", "left", "right", "vertical", "horizontal", "top", and "bottom" are based on orientation or position relationships shown in the accompanying drawings, which are only used to facilitate description of the present invention rather than requiring that the present invention must be constructed and operated in a specific orientation, and therefore cannot be construed as a limitation on the present invention. The terms "connecting", "connected" and "provided" used in the present invention should be understood broadly, for example, may be fixedly connected, and may also be detachably connected; may also be direct connections or indirect connections via intervening components; may also be wired connections or radio connections; and may also be wireless communication signal connections. A person of ordinary skill in the art would have been able to understand the specific meaning of the described terms according to specific situations.

One or more examples of the present invention are illustrated in the accompanying drawings. The detailed description uses numerals and letter markings to refer to features in the drawings. Similar or like reference signs in the drawings and descriptions have been used to refer to similar or like parts of the present invention. As used herein, the terms "first", "second" and "third" and the like are used interchangeably to distinguish one member from another and are not intended to denote the location or importance of individual members.

Figure 2:
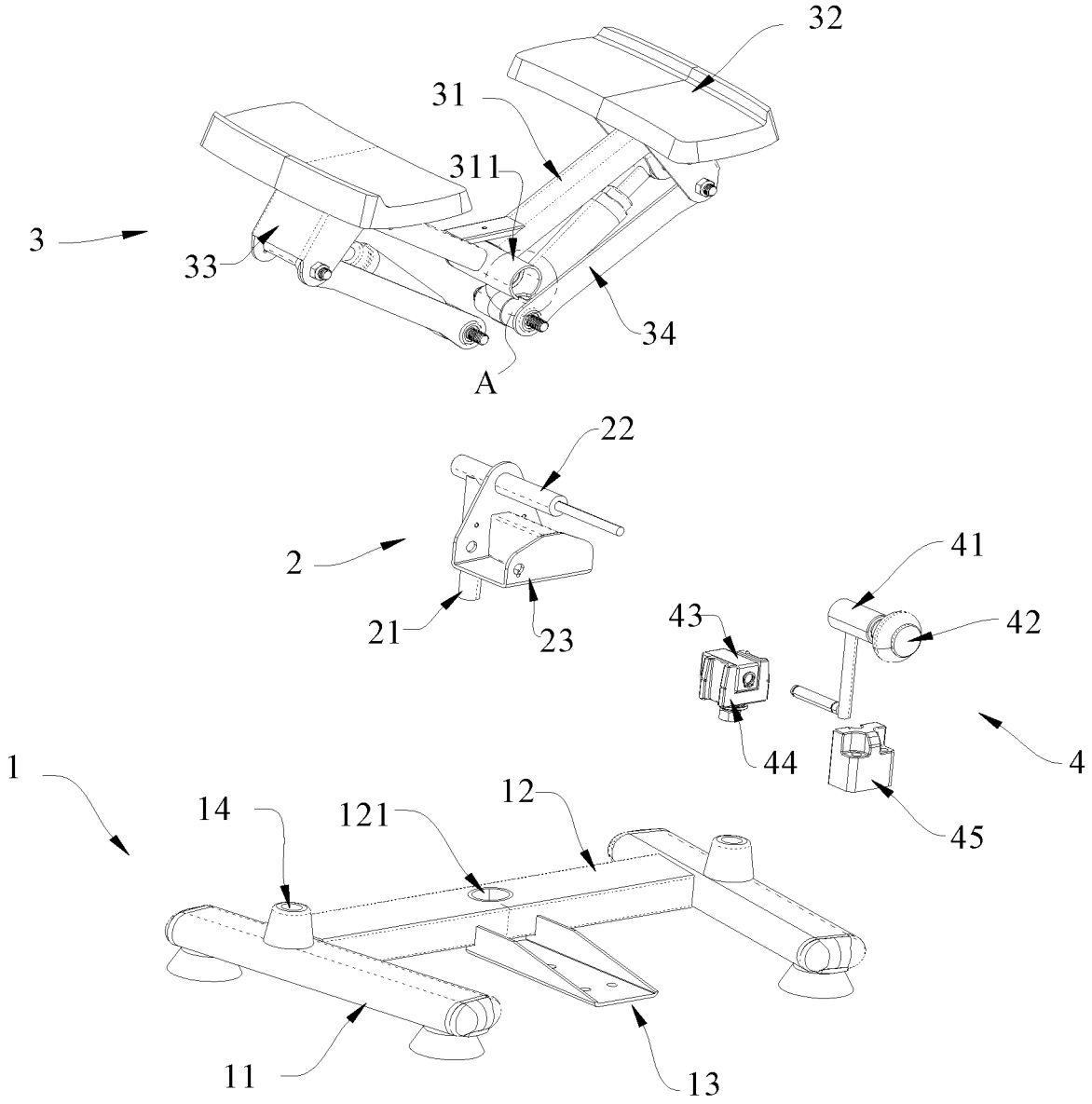
FIG. 2 is schematic exploded structural view of an embodiment of a stair steeper.
Figure 3:
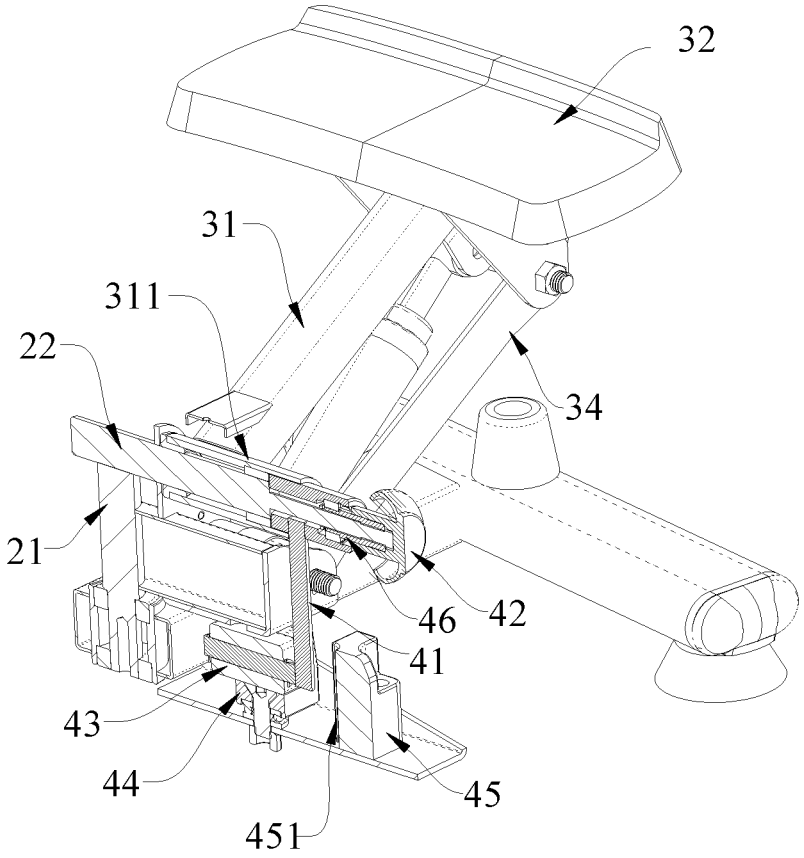
FIG. 3 is a cross-sectional view taken along line A-A in FIG. 1.
Figure 4:
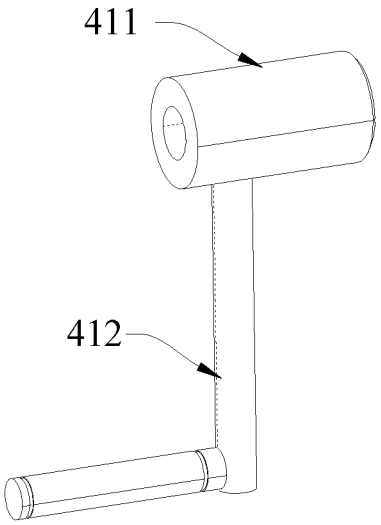
FIG. 4 is a structural schematic diagram of a linkage member of an embodiment of a stair steeper.
Figure 5:
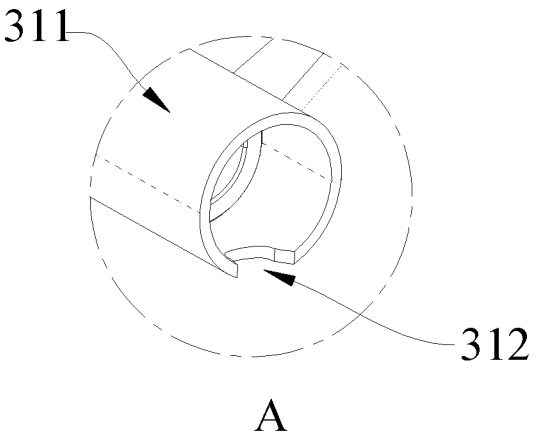
FIG. 5 is an enlarged view of a structure A in FIG. 2.

As shown in FIGS. 1-5, according to an embodiment of the present invention, a stair stepper is provided. The stair stepper comprises a base 1; a rotating mechanism 2 is provided on the base 1, a pedal mechanism 3 is provided on the rotating mechanism 2 and is movably connected to the rotating mechanism 2, and a converting mechanism 4 is provided between the rotating mechanism 2 and the base 1.

The base 1 comprises two supporting beams 11 on the left and right and a crossbeam 12 respectively crossing the two supporting beams 11 in an intersecting manner, and a through-hole 121 is provided in the middle of the crossbeam 12. The rotating mechanism 2 comprises a first rotating shaft 21 and a second rotating shaft 22, and the first rotating shaft 21 is perpendicularly welded and fixed to the second rotating shaft 22. The first rotating shaft 21 penetrates through the through-hole 121, so that the rotating mechanism 2 can rotate on the base 1 by taking the first rotating shaft 21 as an axis. The pedal mechanism 3 is hinged to the second rotating shaft 22, so that the pedal mechanism 3 can rotate around the second rotating shaft 22. Specifically, the pedal mechanism 3 comprises a pedal connecting assembly 31, pedals 32 are provided at two ends of the pedal connecting assembly 31, a first sleeve pipe 311 is provided at the middle of the pedal connecting assembly 31, the first sleeve pipe 311 is sleeved on the second rotating shaft 22, so that the pedal mechanism 3 can rotate around the second rotating shaft 22. The rotating mechanism 2 further comprises a connecting plate 23, the connecting plate 23 is provided below the second rotating shaft 22 and is connected to the second rotating shaft 22, connecting blocks 33 are fixedly connected to the bottoms of the pedals 32 at two sides of the pedal mechanism 3, an upper portion of each of the connecting blocks 33 is hinged to an end portion of the pedal connecting assembly 31, a lower portion of each of the connecting blocks 33 is hinged to one end of the connecting rod 34, and the other end of the connecting rod 34 is hinged to the connecting plate 23, so that the pedal connecting assembly 31, the connecting blocks 33, the connecting rod 34 and the connecting plate 23 form a connecting rod mechanism.

The converting mechanism 4 comprises a linkage member 41, the linkage member 41 comprises a second sleeve pipe 411, a limiting rod 412 is provided on an outer wall of the second sleeve pipe 411, the limiting rod 412 is of an L-shaped rod structure, a vertical rod of the limiting rod 412 is perpendicular to an axis of the second sleeve pipe 411, and a transverse rod of the limiting rod 412 is parallel to the axis of the second sleeve pipe 411. The second sleeve pipe 411 is sleeved on the second rotating shaft 22, so that the linkage member 41 can rotate around the second rotating shaft 22, and the linkage member 41 can slide on the second rotating shaft 22. A first limiting groove 312 is provided at an edge of a pipe opening of the first sleeve 311, so that when the axis of the vertical rod of the limiting rod 412 is parallel to a vertical direction, the vertical rod of the limiting rod 412 can enter the first limiting groove 312, at this time, the pedal mechanism 3 cannot rotate relative to the second sleeve pipe 411, and can only rotate along with the rotation of the second sleeve pipe 411, so that the two pedals 32 on the left and the right can only step up and down along with the rotation of the second sleeve pipe 411. The sliding block 43 is fixedly connected to the transverse rod of the limiting rod 412. A mounting plate 13 is provided at a position, corresponding to the through-hole 121, on the base 1, the mounting plate 13 is rotatably connected to the adapter 44, and the sliding block 43 is mounted in the adapter 44, so that the sliding block 43 can slide in the adapter 44. When the linkage member 41 rotates along with the second rotating shaft 22, the transverse rod of the limiting rod 412 rotates synchronously, and when the second sleeve pipe 411 rotates around the second rotating shaft 22, the sliding block 43 slides in the adapter 44, so that the pedal mechanism 3 moves more smoothly in the process of stepping and twisting. A limiting block 45 is further provided on the mounting plate 13*a*, a second limiting groove 451 is provided on the limiting block 45 at a position corresponding to the adapter 44. When the vertical rod of the limiting rod 412 moves into the second limiting groove 451, the linkage member 41 cannot rotate, such that the rotating mechanism 2 cannot rotate around the first rotating shaft 21. At this time, the pedal mechanism 3 cannot rotate around the first rotating shaft 21, and only the stepping motion can be performed. The converting mechanism 4 further comprises a knob mechanism 42, an inner wall of the knob mechanism 42 is in threaded connection with the second rotating shaft 22, and an outer wall of the knob mechanism 42 is connected to one end of the second sleeve pipe 411 through a rotating shaft sleeve 46, so that the knob mechanism 42 can be axially connected to the second sleeve pipe 411 and can rotate circumferentially relative to the second sleeve pipe 411, thereby adjusting the position of the linkage member 41 on the second rotating shaft 22 by adjusting the rotation amount of the knob mechanism 42 on the second rotating shaft 22.

Two stopping blocks 14 of a flexible material are further provided on the base 1; when the pedal mechanism 3 steps downwards until the connecting block 33 touches the stopping blocks 14, the distance is a single-side maximum stroke of the pedal 32. The stopping blocks 14 of a flexible material can provide a collision buffer between the pedal mechanism 3 and the stopping blocks, thereby preventing the pedal mechanism 3 from directly contacting the base 1 and causing damage to a limb of a user and reducing structural damage. Also, the stopping blocks 14 can also be provided at the bottom of the connecting block 33 to act as a collision buffer between the pedal mechanism 3 and the base 1.

Preferably, a bearing is provided in the through-hole 121, thereby facilitating rotation of the first rotating shaft 21.

Preferably, a bearing is provided between the first sleeve pipe 311 and the second rotating shaft 22, thereby facilitating rotation of the first sleeve pipe 311 on the second rotating shaft 22.

Preferably, an included angle between inner sides of the two supporting beams 11 and the crossbeam 12 of the base 1 is an acute angle, so that one side between the two supporting beams 11 presents a small opening, the other side between the two supporting beams presents a large opening, and the mounting plate 13 is provided on the side of the crossbeam 12, with a small opening between the two supporting beams 11. While the stability and safety of the structure during use are ensured, the structure is more compact and the occupation area is smaller.

The operation principle is as follows: the knob mechanism 42 rotates outwards, so that the vertical rod of the limiting rod 412 moves away from the first limiting groove 312 and is located within the second limiting groove 451, and at this time, the pedal mechanism 3 cannot rotate around the first rotating shaft 21, and can only perform the alternating stepping motion of the two pedals 32; the knob mechanism 42 rotates inwards, so that the vertical rod of the limiting rod 412 moves away from the second limiting groove 451 and is located within the first limiting groove 312, and at this time, the pedal mechanism 3 can rotate around the first rotating shaft 21, and at the same time, the linkage member 41 rotates around the second rotating shaft 22, so that the pedal mechanism 3 rotates along with the rotation of the linkage member 41, thereby achieving synchronous stepping and twisting training.

From the above description, it can be seen that the above embodiment of the present invention achieves the following technical effects.

1. The present invention can achieve the synchronization of stepping and twisting training, can not only be used for pure oxygen stepping to fat burn, but also can perform twisting training for strengthening a core muscle group, thereby greatly improving the practicability and diversity of equipment.
2. The present invention can satisfy the switching of functions of stepping training and stepping-twisting training; and a user can easily switch different training functions according to an individual exercise demand and target.
3. The present invention achieves the rapid switching of a training function through a rotating knob mechanism; through a simple and efficient rotating knob mechanism design, a user can rapidly switch between different training modes simply by rotating a rotating knob without a complex operation, thereby greatly improving the convenience and smoothness of training, and enabling a gym to be more focused on the exercise itself rather than complex regulation and control of equipment.
4. The simultaneous processes of stepping-twisting-training are smoother, so that when composite training is performed, the motion conversion of the upper and lower limbs is naturally smooth. The present invention can not only reduce discomfort during exercise, but also simulate a motion mode closer to daily life during actual exercise, so that the exercise effect is closer to a scene of daily life, thereby facilitating improvement of motion conversion efficiency.

Compared with the prior art, the stair stepper of the present invention has two motion functions, and can be rapidly switched between the two functions, thereby providing a user with a plurality of motion functions, being more convenient to use, and having a smoother motion process.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A stair stepper, comprising: a base; a rotating mechanism comprising a first rotating shaft and a second rotating shaft that are fixed in an intersecting manner, the rotating mechanism being rotatably connected to the base through the first rotating shaft; and a pedal mechanism, a first sleeve pipe being provided in the middle of the pedal mechanism, and the pedal mechanism being rotatably sleeved on the second rotating shaft through the first sleeve pipe, wherein the stair stepper further comprises a linkage member, the linkage member comprises a second sleeve pipe, a limiting rod is provided on an outer wall of the second sleeve pipe, a vertical rod of the limiting rod is perpendicular to an axis of the second sleeve pipe and is fixedly connected to the second sleeve pipe, and a transverse rod of the limiting rod is parallel to the axis of the second sleeve pipe;

the first sleeve pipe and the second sleeve pipe are sequentially sleeved on the second rotating shaft, and the linkage member is capable of rotating around the second rotating shaft and is capable of sliding on the second rotating shaft; an adapter is rotatably connected to a mounting position, corresponding to the first rotating shaft, on the base, and the transverse rod of the limiting rod is slidably connected to the adapter;

a first limiting groove is provided at an edge of a pipe opening at one side, adjacent to the second sleeve pipe, of the first sleeve pipe, and a second limiting groove is provided on the base, so that when the linkage member slides towards the side of the first sleeve pipe, the vertical rod of the limiting rod is capable of entering the first limiting groove, and when the linkage member slides away from the side of the first sleeve pipe, the vertical rod of the limiting rod is capable of entering the second limiting groove.

2. The stair stepper according to claim 1, wherein a through-hole is provided in the base, and the first rotating shaft penetrates through the through-hole and is connected to the base.

3. The stair stepper according to claim 2, wherein a mounting plate is provided at a position, corresponding to the through-hole, on the base, and the adapter is rotatably connected to the mounting plate.

4. The stair stepper according to claim 3, wherein a limiting block is mounted on the mounting plate, and the second limiting groove is provided on one side, corresponding to the through-hole, of the limiting block.

5. The stair stepper according to claim 1, wherein the base comprises two supporting beams symmetric to left and right, and a crossbeam respectively connected to the two supporting beams in an intersecting manner; the first rotating shaft is mounted on the crossbeam; and included angles between inner sides of the two supporting beams and the crossbeam are acute angles, so that one side between the two supporting beams presents a small opening, and the other side between the two supporting beams presents a large opening.

6. The stair stepper according to claim 5, wherein the adapter and the second limiting groove are provided on the side having the small opening between the two supporting beams.

7. The stair stepper according to claim 1, wherein the linkage member is provided with a U-shaped groove, a sliding block is mounted inside the U-shaped groove, and the transverse rod of the limiting rod is fixedly connected to the sliding block.

8. The stair stepper according to claim 1, wherein the stair stepper further comprises a knob mechanism, wherein an inner wall of the knob mechanism is in threaded connection with the second rotating shaft, and an outer wall of the knob mechanism is connected to one end of the second sleeve pipe through a rotating shaft sleeve, so that the knob mechanism is capable of being axially connected to the second sleeve pipe and is capable of rotating circumferentially relative to the second sleeve pipe.

9. The stair stepper according to claim 1, wherein two stopping blocks of a flexible material are further provided on the base; and when the pedal mechanism steps downwards, the pedal mechanism is capable of touching the stopping blocks so as to prevent the pedal mechanism from directly colliding with the base.

10. The stair stepper according to claim 1, wherein two stopping blocks of a flexible material are further provided under a pedal of the pedal mechanism; and when the pedal mechanism steps downwards, the stopping blocks are capable of touching the base so as to prevent the pedal mechanism from directly colliding with the base.

* * * * *